United States Patent [19]

Suzuki

[11] 4,423,963

[45] Jan. 3, 1984

[54] ELECTRONIC TIMEPIECE HAVING ILLUMINATION LEVEL

[75] Inventor: Fuminori Suzuki, Tanashi, Japan

[73] Assignee: Citizen Watch Company Limited, Tokyo, Japan

[21] Appl. No.: 418,130

[22] Filed: Sep. 15, 1982

[30] Foreign Application Priority Data

Sep. 18, 1981 [JP] Japan ..... 56-147451
Aug. 17, 1982 [JP] Japan ..... 57-141654

[51] Int. Cl.[3] ..... G04B 19/22; G04B 19/24

[52] U.S. Cl. ..... 368/68; 368/34; 368/62

[58] Field of Search ..... 368/10, 11, 68, 82, 368/84, 239, 240, 242, 21, 28, 29, 34, 62, 80, 84, 321; 354/23 R, 23 D, 76, 53, 60 L; 350/336

[56] References Cited

U.S. PATENT DOCUMENTS 4,095,405 6/1978 Tanaka ..... 368/34
4,312,056 1/1982 Nishimura ..... 368/28 X

*Primary Examiner*—J. V. Truhe
*Assistant Examiner*—Terrance L. Flower
*Attorney, Agent, or Firm*—Jordan and Hamburg

[57] ABSTRACT

An electronic timepiece is provided with a photo-electric cell generating an output voltage indicative of incident illumination levels, circuit means for converting this output voltage into digital data signals, and a liquid crystal display which is driven in response to the data signals such that successive sections of the display act to progressively unmask a rear reflector plate to thereby indicate the illumination level. The circuits for converting illumination level to data signals are based on an oscillator circuit whose frequency is controlled by the photo-electric cell voltage, and digital means for measuring this frequency, so that the circuit configuration is very simple and power comsumption extremely low.

13 Claims, 9 Drawing Figures

ELECTRONIC TIMEPIECE HAVING ILLUMINATION LEVEL

BACKGROUND OF THE INVENTION

The present invention relates to an electronic timepiece which is provided with means for sensing and displaying the level of ambient illumination, with these means being based on very simple circuits having an extremely low level of power consumption. Thus, the present invention is highly suitable for use even in an extremely miniaturized and thin electronic timepiece and can be used to readily confirm ambient illumination conditions such as on desk tops or any other location or to check the exposure condition when taking photographs.

Essentially, an electronic timepiece according to the present invention is provided with a photo-electric cell (it should be noted that in the specification and claims of the present invention, the term "photo-electric cell" is used as a generic term to cover the various types of electronic devices which have been developed to produce an output voltage varying with the level of illumination incident on the device, e.g. photo-diodes, etc), circuit means for converting the output voltage from the photo-electric cell into digital data signals, and display means for indicating the level of illumination in response to these digital data signals. The particular feature of novelty of the present invention lies in the use of an oscillator circuit whose frequency of oscillation varies in accordance with the level of supply voltage applied thereto, with this supply voltage comprising the output voltage from the photo-electric cell. Simple digital frequency measuring circuit means are used to generate digital data signals indicating this frequency of oscillation, and these digital data signals are applied to a display device which is responsive thereto for displaying the level of illumination.

In the prior art, various systems have been proposed for providing means to indicate the ambient level of illumination in a miniature electronic device such as a wristwatch, electronic pocket calculator, etc. However such devices have generally been based on the use of an analog-to-digital converter circuit to convert the output voltage from a photo-electric cell into digital data signals. Use of such an analog-to-digital converter circuit usually requires the incorporation of circuit means for generating a reference voltage, for comparison with the output voltage produced by the photo-electric cell, and in general, the generation of such a reference voltage will require an appreciable level of current consumption, by comparison with the overall level of current consumption of a device such as an electronic wristwatch. As a result of this disadvantage, almost none of the prior art proposals for illumination level sensing and display means in a device such as an electronic timepiece have been brought to the level of actual manufacture.

SUMMARY OF THE INVENTION

With an electronic timepiece according to the present invention, however, the disadvantage of a high level of power consumption which arises with the use of an analog-to-digital converter circuit is effectively eliminated. In addition, the overall circuit configuration of illumination sensing and display means according to the present invention can be made such simpler than that of a system which employs an analog-to-digital converter circuit, as will be shown by the description of the preferred embodiment, so that the system according to the present invention can be easily incorporated into even an extremely small and thin electronic timepiece. The system according to the present invention can be used with either digital or analog display means, to indicate the level of illumination. In addition, the photo-electric cell used to sense the ambient level of illumination can also be used to charge the timepiece battery, with this battery charging operation and the illumination sensing operation being performed on a time-sharing basis.

DESCRIPTION OF THE PREFERRED EMBODIMENT

Figure 1:
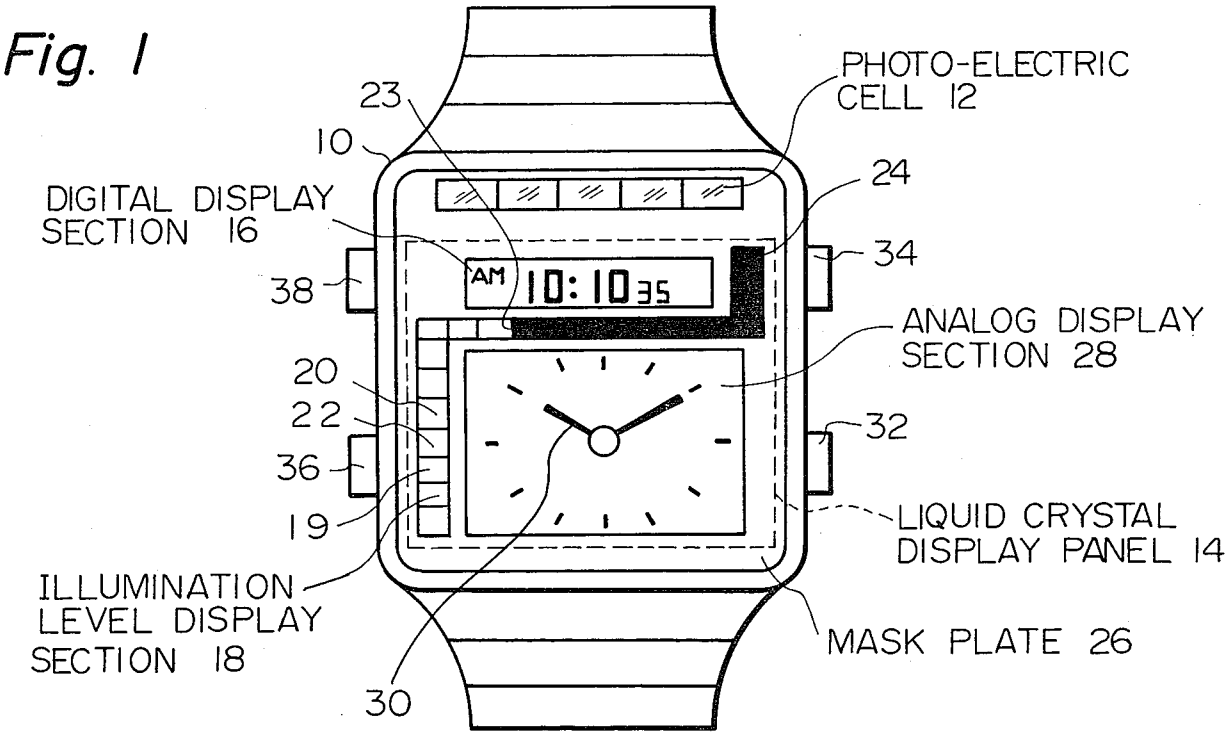
FIG. 1 is a plan view of an embodiment of an electronic timepiece provided with means for sensing and displaying the ambient level of illumination according to the present invention.

Referring to the drawings, FIG. 1 is an external plan view of an embodiment of an electronic timepiece according to the present invention. Numeral 10 denotes the watch case. Numeral 12 denotes a photo-electric cell. Numeral 14 denotes a liquid crystal display panel, and numeral 26 a mask plate which is positioned below the liquid crystal display panel 14. Liquid crystal display panel 14 is divided into three sections, by window apertures which are formed in mask plate 26, these sections being a digital display section 16 for displaying time information, an illumination level display section 18 for displaying the ambient illumination level, i.e. the intensity of light which is incident on photo-electric cell 12, and an analog display section 28. The latter provides a display of time information by means of hands and dial graduations. Numerals 32, 34, 36 and 38 denote a set of externally actuated switches, which are used to select the operating mode, display digits, for correction of the displayed time information, etc.

During normal operation of the timepiece, time information is displayed both by the digital display section 16 and the analog display section 28. By actuating the externally operated switches, 32, 34, 36 or 38, the displayed time informationn can be corrected, or a stopwatch or timer function can be selected. The display state of illumination level display section 18 is altered under the control of the output voltage generated by photo-electric cell 12. This is done by selectively masking and unmasking portions of a reflector plate (described hereinafter) which is positioned below liquid crystal display panel 14 by suitably driving liquid crystal display panel 14, to thereby form a dark region (denoted by numeral 24) in a masked portion of illumination level display section 18, i.e. a portion in which liquid crystal display panel 14 is driven into a non-transparent state, and a bright region 19 of illumination level display section 18, i.e. a portion in which liquid crystal display panel is made transparent, to thereby permit reflection of light from the reflector plate below. It is a feature of this embodiment that the formation of these bright and dark regions of illumination level display section 18 is performed by progressively driving successive adjacent segments of liquid crystal display panel 14 in illumination level display section 18, such as the segments denoted by numerals 20 and 22, into the transparent or non-transparent state.

In this embodiment, illumination level display section 18 is formed into a crank shape, with a lateral portion 23 which is positioned between the digital display section 16 and the analog display section 28. This crank shape serves to facilitate recognition of the amount of illumination level display section 18 which is in the bright condition, i.e. serves to provide easier recognition of the illumination level which is indicated than would be the case if illumination level display section 18 were simply arranged as a single straight line. In other words, this crank shape of illumination level display section 18 serves the function of very simple graduations. In addition with this embodiment, as described hereinafter, colored regions are formed on the reflector plate below photo-electric cell 12, in the area of illumination level display section 18, to provide an improved effect of display graduations.

In this embodiment, the segments of liquid crystal display panel which are successively driven into the transparent or non-transparent state to indicate the illumination level, e.g. segments 20 and 22 of illumination level display section 18, are arranged in a linear manner. However it is equally possible to arrange such segments in some other suitable shape, for example they could consist of equiangular segments of a disk. However, irrespective of the particular overall shape which is formed by the segments, it is a feature of the present invention that adjacent segments are successively and progressively driven into a state such as to provide a particular display state in a certain area (e.g. a bright, reflecting state), with the size of this area progressively increasing to indicate a corresponding increase in the ambient illumination level.

Figure 2:
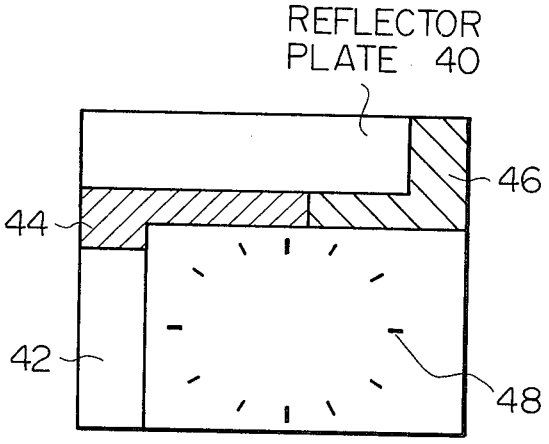
FIG. 2 is a plan view of a reflector plate which is mounted behind a liquid crystal display panel in the preferred embodiment of an electronic timepiece.

FIG. 2 is a plan view of a reflector plate 40 used in the present embodiment. As shown, this is provided with regions 42, 44 and 46, which each has a different color, and a set of graduation marks 48 for analog display section 28. The colored regions 42, 44 and 46 of reflector plate 40 are positioned below the illumination level display section 18 of liquid crystal display panel 14, and provide enhanced recognition of the illumination level which is indicated by illumination level display section 18, and also serve to provide a more attractive and interesting display. It has been found that the colored regions 42, 44 and 46 also provide a more effective function as graduations if they are staggered with respect to the line portions of the crank shape of illumination level display section 18, as shown in the diagram.

Figure 3:
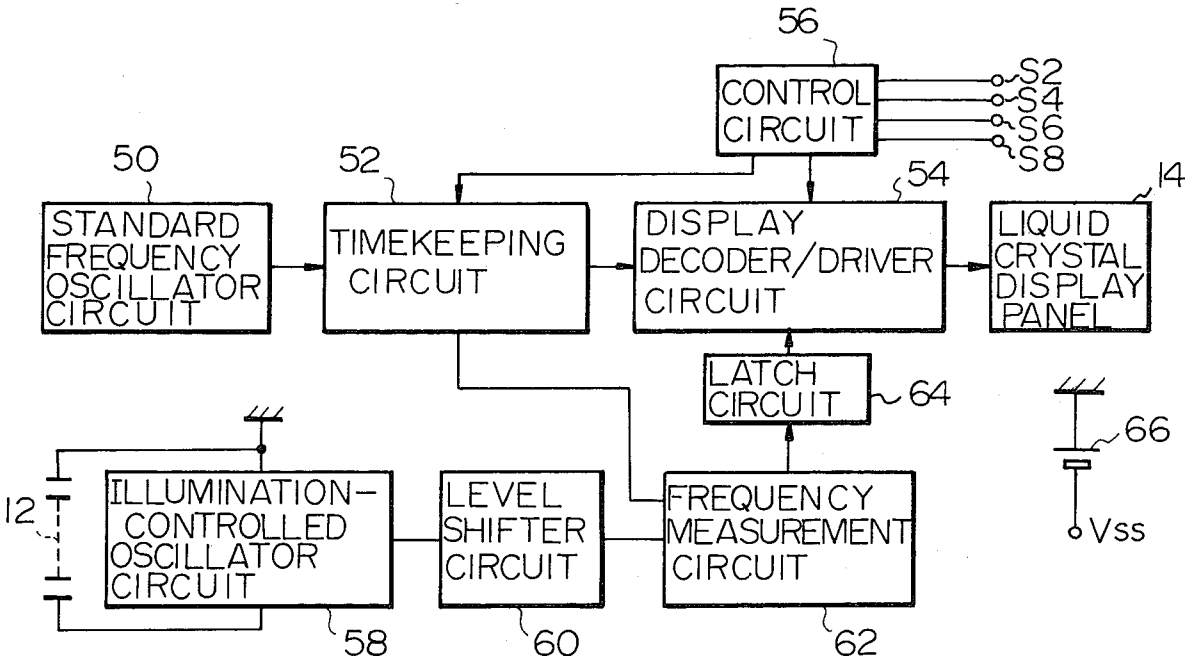
FIG. 3 is a simplified overall block circuit diagram of the preferred embodiment of an electronic timepiece.

FIG. 3 is a block circuit diagram of this embodiment of an electronic timepiece according to the present invention. Numeral 50 denotes a quartz crystal oscillator circuit used as a standard frequency signal source. This serves to produce a standard frequency signal which is input to a timekeeping circuit 52. The timekeeping circuit 52 performs frequency division of the standard frequency signal to produce various timing signals, as described hereinafter, and time information signals indicating current time information. The time information signals are applied to a display decoder/drive circuit 54, which responds by producing drive signals to drive the digital display section 16 of liquid crystal display panel 14 to indicate time information. Time information signals from timekeeping circuit 52 are also applied to a drive circuit which drives a stepping motor to advance the hands in analog display section 28. However such an arrangement is very well known, and therefore is omitted from FIG. 3, for simplicity of description. Numeral 56 denotes a switch control circuit which is coupled to receive switch signals from switches 32 to 38, for thereby generating control signals to initiate display changeover, function changeover, time correction, etc.

The photo-electric cell 12 generates an output voltage which varies in accordance with the ambient illumination level, and this voltage is applied as the power supply voltage to an illumination-controlled oscillator circuit 58. In the present embodiment, illumination-controlled oscillator circuit 58 is a simple ring oscillator circuit, as will be described hereinafter, whose frequency of oscillation varies in accordance with the level of supply voltage applied thereto. The output signal from this ring oscillator circuit 58 is input to a level shifting circuit 60, which converts the level of this output signal to logic circuit voltage levels. This is necessary due to the fact that the amplitude of the output signal voltage from ring oscillator circuit 58 will of course vary in accordance with the level of supply voltage applied to the circuit, and this will vary in accordance with the illumination level incident on photo-electric cell 12. The output signal thus produced by level shifting circuit 60 is input to a frequency measurement circuit 62. This frequency measurement circuit 62 serves to measure the frequency of the output signal from ring oscillator circuit 58, using timing signals produced from timekeeping circuit 52, i.e. using the standard frequency signal from quartz crystal oscillator circuit 50 as a frequency reference. Digital data signals are thereby produced from frequency measurement circuit 62, indicating the frequency of oscillation of ring oscillator circuit 58, and hence the ambient illumination level incident on photo-electric cell 12. These digital data signals are periodically transferred to a latch circuit 64, and stored therein. The digital data signal outputs from latch circuit 64 are input to display decoder/drive circuit 54, which thereby drives the illumination level display section 18 of liquid crystal display panel 14 to indicate the level of ambient illumination, i.e. drives a successively increasing number of the display segments 20, 22 etc of liquid crystal display panel shown in FIG. 1 into the transparent state as the illumination level increases.

The frequency measurement circuit 62 uses a gate timing signal to measure the frequency of oscillation of ring oscillator circuit 58, with this gate timing signal being generated using reference timing signals produced from timekeeping circuit 52. The digital data signals produced by frequency measurement circuit 62 are updated periodically at a suitable rate, e.g. several times per second or several hundred times per second.

Figure 4:
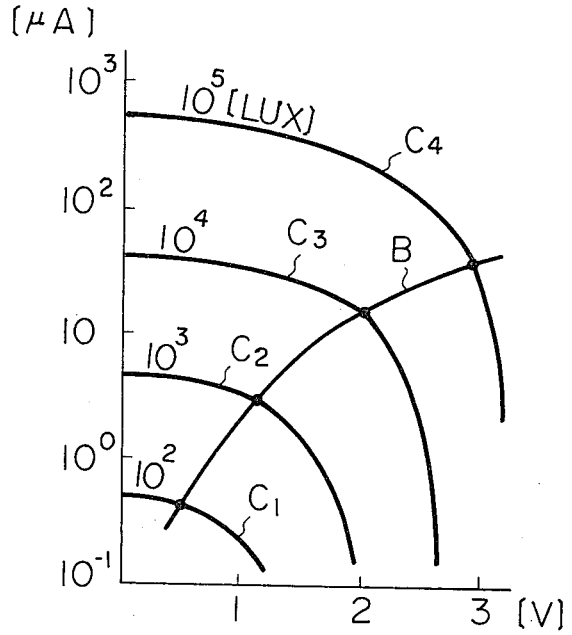
FIG. 4 is a graph showing the relation between level of illumination, output voltage and current for a photo-electric cell used in the preferred embodiment of an electronic timepiece, and the current/voltage characteristic of a ring oscillator circuit used in that embodiment.

FIG. 4 is a diagram showing the load characteristics of photo-electric cell 12, for the case in which this comprises an amorphous silicon solar cell. The diagram also shows the operating points of ring oscillator circuit 58 at several different levels of incident illumination of photo-electric cell 12, assuming that ring oscillator circuit 58 operates from a power supply voltage produced by photo-electric cell 12. Voltage is plotted along the horizontal axis, and current along the vertical axis. C1, C2, C3 and C4 denote the load characteristic curves of the amorphous silicon solar cell used as photo-electric cell 12, for illumination levels of $10^2$, $10^3$, $10^4$ and $10^5$ lux respectively. Curve B is the voltage/current characteristic of ring oscillator circuit 58, so that the intersections between curve B and curves C1, C2, C3 and C4 represent the operating points of ring oscillator circuit 58 for the respective illumination levels.

Figure 5:
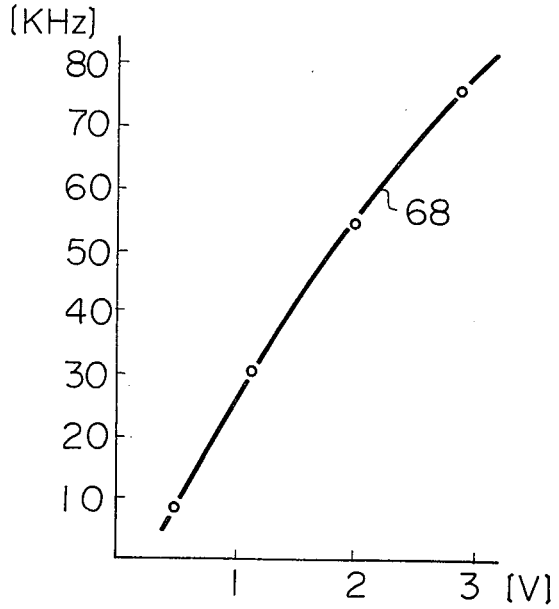
FIG. 5 is a graph showing the relationship between supply voltage and oscillation frequency for the ring oscillator circuit used in the preferred embodiment of an electronic timepiece.
Figure 6:
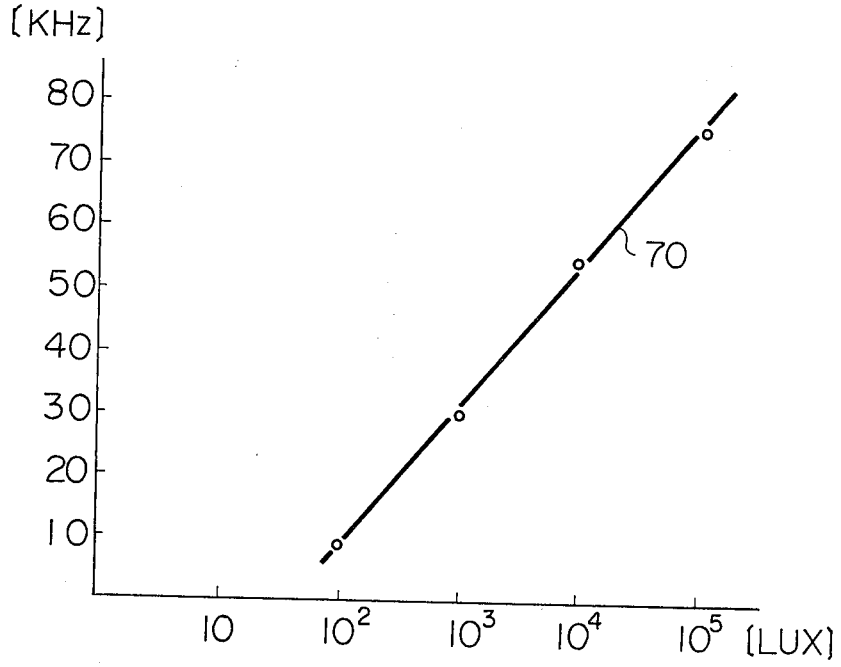
FIG. 6 is a graph showing the relationship between level of illumination incident on the photo-electric cell and the frequency of oscillation of the ring oscillator circuit powered by that photo-electric cell, in the preferred embodiment of an electronic timepiece.

FIG. 5 is a graph showing the relationship between the frequency of oscillation of ring oscillator circuit 58 and the supply voltage applied thereto, and by combining this characteristic with the operating points shown in FIG. 4, the graph of FIG. 6 can be obtained. This shows the relationship between the illumination level incident on photo-electric cell 12 and the frequency of oscillation of ring oscillator circuit 58, for the case of a simple ring oscillator circuit having the configuration described hereinafter, and with an amorphous silicon solar cell being used as photo-electric cell 12. As can be seen from FIG. 6, the frequency of oscillation of ring oscillator circuit 58 varies in a substantially linear manner with respect to changes in the ambient illumination level. As a result, digital data signals representing the illumination level can be very easily derived, simply by measuring the frequency of oscillator of ring oscillator circuit 58, using the standard frequency signal generated by quartz crystal oscillator circuit 50 as a frequency reference for this measurement.

Figure 7:
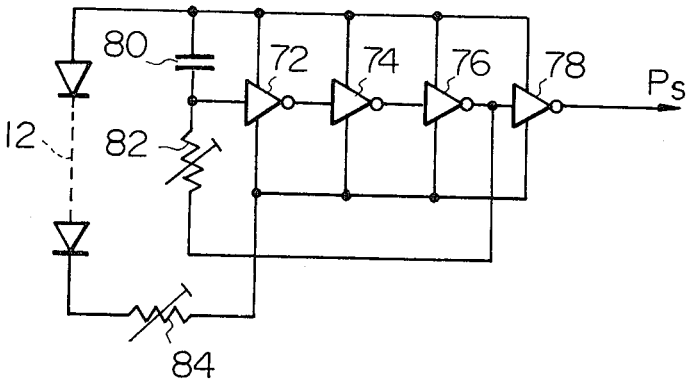
FIG. 7 is a circuit diagram of the ring oscillator circuit used in the preferred embodiment of an electronic timepiece.

FIG. 7 is a diagram showing an example of a specific configuration for an illumination-controlled oscillator circuit to be used as ring oscillator circuit 58. This ring oscillator circuit operates from the output voltage produced by photo-electric cell 12 as power supply, with this photo-electric cell 12 comprising an amorphous silicon solar cell, as stated above. The ring oscillator circuit 58 comprises an odd number of invertor stages connected in series, i.e. inverters, 72, 74 and 76, formed of CMOS transistors, with the output from inverter 76 being coupled to the input of inverter 72 through a time constant circuit comprising a variable resistor 82 and a capacitor 80, and with inverter 78 serving as a buffer from which the oscillation signal is output. The frequency of oscillation of ring oscillator circuit 58 can be varied by adjusting variable resistor 82. Numeral 84 denotes a variable resistor which is connected in series between the power source terminals of the set of inverters 72 to 78 and the photo-electric cell 12. The frequency/illumination level characteristic of the ring oscillator circuit 58 can be varied by altering the value of variable resistor 84, to thereby adjust the supply voltage applied to inverters 72 to 78.

Use of an amorphous silicon solar cell as photo-electric cell 12 has a number of important advantages. With such a solar cell, the output voltage at a given level of illumination is substantially constant, for different wavelengths of light. In addition, the output voltage produced is relatively high.

Figure 8:
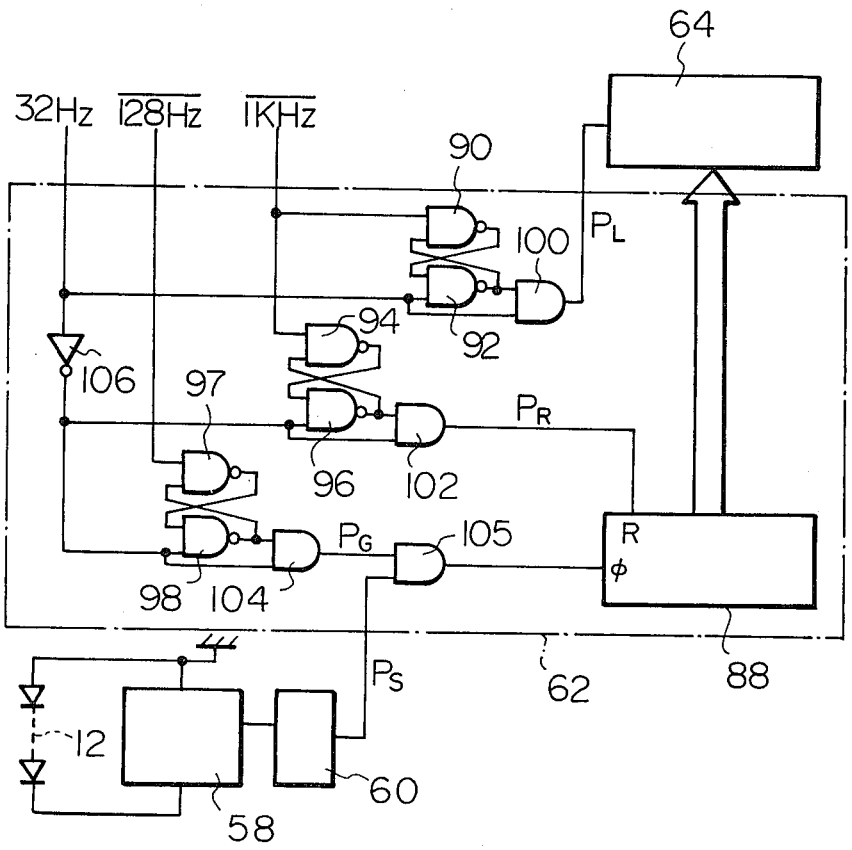
FIG. 8 is a partial circuit diagram illustrating circuit means for converting the output signal from the illumination level-controlled ring oscillator circuit into digital data signals, in the preferred embodiment of an electronic timepiece.
Figure 9:
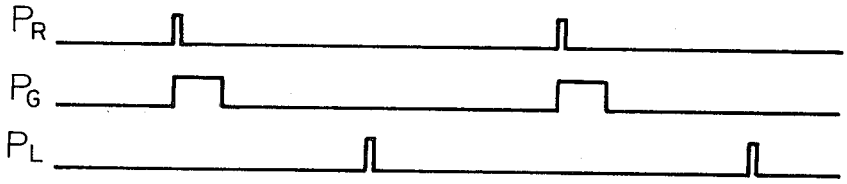
FIG. 9 is a timing diagram.

FIG. 8 is a circuit diagram of a specific example of frequency measurement circuit 62 shown in FIG. 3. This comprises a counter circuit 88 and three sets of gate circuits, composed of six NAND gates 90, 92, 94, 96, 97 and 98, four AND gates 100, 102, 104 and 105, and an inverter 106. The circuit arrangement is very simple, and therefore will not be described in detail. As shown, NAND gates 90 and 92 are cross-coupled to form a flip-flop circuit, with the output and one of the inputs of NAND gate 92 being input to AND gate 100. NAND gates 94 and 96, with AND gate 102, and NAND gates 97 and 98 with AND gate 104 are connected in a similar manner. A 32 Hz signal is input to NAND gate 92 while a $\overline{1\ KHz}$ signal is input to NAND gate 90. This $\overline{1\ KHz}$ signal is produced in timekeeping circuit 52 by inverting a 1 KHz signal which is synchronized with the 32 Hz signal. The $\overline{1\ KHz}$ signal is also input to NAND gate 94, while the 32 Hz signal is input to inverter 106, whose output is input to NAND gate 96 and 98. A $\overline{128\ Hz}$ signal, produced in timekeeping circuit 52 by inverting a 128 Hz signal synchronized with the 32 Hz signal, is input to NAND gate 97. These 32 Hz, $\overline{128\ Hz}$ and $\overline{1\ KHz}$ timing signals are produced within timekeeping circuit 52 by frequency division of the standard frequency signal generated by quartz crystal oscillator circuit 50, i.e. quartz crystal oscillator circuit 50 is used as a frequency reference for the circuit of FIG. 8. As a result of these timing signals, pulses PR, PG and PL, shown in the timing diagram of FIG. 9, are generated from AND gates 102, 104 and 100 respectively.

The output signal from ring oscillator circuit 58, after level shifting by level shifting circuit 60, is designated as the oscillation signal PS, and is input to AND gate 105, to be transferred through that gate under the control of the gate timing signal PG from AND gate 104. The pulses of signal PS thus transferred are applied to the clock input terminal $\phi$ of counter circuit 88. The reset signal pulse PR is applied to a reset terminal R of counter circuit 88, while the latch timing pulse PL from AND gate 100 is applied to control read-in of the contents of counter circuit 88, i.e. digital data signals, to be stored in latch circuit 64.

The operation of the frequency measurement circuit of FIG. 8 will now be described. First, prior to a reset signal pulse PR being produced, gate timing signal PG is at the low logic level, so that AND gate 105 is inhibited, and the oscillation signal PS is not transferred to the clock terminal $\phi$ of counter circuit 88. When a pulse of reset signal PR is produced, then counter circuit 88 is reset to a count of zero, and at the same time, gate signal PG goes to the high logic level, so that AND gate 105 is enabled, and oscillation signal PS is transferred to the clock input terminal $\phi$ of counter circuit 88. At this time, counter circuit 88 is still being held in the reset state by the reset pulse PR, so that no counting by counter circuit 88 occurs. When reset signal PR falls to the low logic level, counting of the pulses of oscillation signal PS by counter circuit 88 begins, and continues until gate timing signal PG falls to the low logic level. Thus, during a time interval determined by the duration of a gate timing signal PG pulse, a number of pulses proportional to the frequency of oscillation of ring oscillator circuit 58 will be counted by counter circuit 88. Subsequently, when a pulse of latch timing signal PL is produced from AND gate 100, this pulse causes the count contents of counter circuit 88 to be stored in latch circuit 64 and stored therein. Latch circuit 64 thereby produces a set of digital data signals which represent the frequency of oscillation of ring oscillator circuit 58 during the previous gate timing signal PG pulse interval, and hence, since as described previously this frequency of oscillation of ring oscillator circuit 58 varies in a substantially linear manner with respect to the illumination level incident on photo-electric cell 12, the digital data signals from latch circuit 64 represent the ambient illumination level. These digital data signals from latch circuit 64 are input to display decode drive circuit 54, which thereby drives the illumination level display section 18 of liquid crystal display panel 14 to display the illumination level, as described above.

In this way, the displayed illumination level is updated periodically, e.g. at a rate of several times per second or several hundred times per second, by transfer of the count contents of counter circuit 88 to latch circuit 64. As can be seen, the configuration of frequency measurement circuit 62 can be extremely simple, so that both ring oscillator circuit 58 and frequency measurement circuit 62 can be easily formed using CMOS FET elements within the integrated circuit chip of an electronic timepiece, with no appreciable increase in the size of the chip or power consumption.

It is possible to use either a digital or an analog method of adjustment, to compensate for manufacturing deviations in the frequency of oscillation of ring oscillator circuit 58. However in the described embodiment, a simple analog method of adjustment is employed, using variable resistors 82 and 84. Digital adjustment could be carried out by setting a preset value into counter circuit 88 in frequency measurement circuit 62, or by performing frequency division of the oscillation signal PS by an adjustable division ratio, before input to counter circuit 88.

The photo-electric cell 12 can also be used to charge the timepiece battery 25, during intervals between sensing of the illumination level. This can be done by time-sharing operation, using the gate timing signal PG as switching signal.

It should now be appreciated that in accordance with the present invention an illumination-controlled oscillator circuit means is directly powered by an output voltage varying in amplitude with the level of illumination incident on a photo-electric sensing means, whereby variations in incident illumination can be directly converted into an accurate frequency of the illumination-controlled oscillator circuit means.

It should be noted that with an illumination level measurement system according to the present invention, almost all of the power required to perform sensing of the illumination level is provided by photo-electric cell 12, so that additional power consumption from the timepiece battery resulting from incorporation of this system will be negligible. In addition, this low level of increased power consumption is further enhanced by the face that the output voltage from photo-electric cell 12 will be zero under conditions of darkness, so that ring oscillator circuit 58 will cease to oscillate.

It can therefore be understood from the above that use of an illumination level measurement and display system in an electronic timepiece according to the present invention offers substantial advantages over conventional systems which employ analog-to-digital converter circuits, from the aspects of circuit simplicity and lower power consumption. A system according to the present invention is therefore highly suitable for incorporation in an ultra-miniature electronic device such as an electronic wristwatch, enabling the number of functions provided by such a device to be increased and thereby enhancing the market appeal.

It should be noted that although the present invention has been described with reference to a specific embodiment in the above, various changes and modifications to the described embodiment may be envisaged, which fall within the scope claimed for the invention. This scope is defined in the appended claims.

What is claimed is:

1. In an electronic timepiece powered by a battery and provided with a standard frequency signal source for generating a standard frequency signal, timekeeping circuit means for frequency dividing said standard frequency signal to produce a plurality of timing signals, and time indicating means responsive to said timing signals for providing a display of time information, an illumination level display system, comprising:

photo-electric sensing means for generating an output voltage which varies in amplitude with the level of illumination incident thereon;

illumination-controlled oscillator circuit means powered by said output voltage from the photo-electric sensing means for generating an oscillation signal whose frequency is determined by the amplitude of said output voltage;

frequency measurement circuit means coupled to receive said oscillation signal and said timing signals from said timekeeping circuit means, for generating data in digital form indicative of the frequency of said oscillation signal;

display drive means responsive to said digital data from said frequency measurement circuit means for generating display drive signals; and illumination level display means driven by said display drive signals for providing a display of the illumination level incident on said photo-electric sensing means.

2. An electronic timepiece as claimed in claim 1, in which said time indicating means comprise an opto-electric display device, and in which said illumination level display means comprise a portion of said opto-electric display device.

3. An electronic timepiece as claimed in claim 2, in which said illumination level display means comprise a plurality of display segments, and in which successively adjacent ones of said display segments are driven progressively from a first display state into a second display state as said illumination level increases.

4. An electronic timepiece as claimed in claim 3, in which said opto-electric display device is a liquid crystal display device, and in which said first display state is a non-transparent condition of the liquid crystal and said second display state is a transparent state of the liquid crystal.

5. An electronic timepiece as claimed in claim 4, in which said liquid crystal display device comprises a reflector plate positioned at the rear thereof, and in which a plurality of colored regions are formed on said reflector plate.

6. An electronic timepiece as claimed in claim 5, in which said display segments of said illumination level display means are arranged to form consecutively arranged horizontal and vertical line portions.

7. An electronic timepiece as claimed in claim 1, and further comprising level shifting circuit means provided between said illumination-controlled oscillator circuit means and said frequency measurement means.

8. An electronic timepiece as claimed in claim 7, in which said illumination-controlled oscillator circuit means comprise a ring oscillator circuit.

9. An electronic timepiece as claimed in claim 8, in which said ring oscillator circuit comprises an odd number of inverter stages, each of said inverter stages comprising CMOS transistor elements.

10. An electronic timepiece as claimed in claim 9, in which said ring oscillator circuit comprises a time constant circuit, with a part of said time constant circuit comprising a variable resistor, said variable resistor functioning as adjustment means for adjusting the frequency of oscillation of said ring oscillator circuit.

11. An electronic timepiece as claimed in claim 9, in which said ring oscillator circuit comprises a variable resistor coupled between supply voltage terminals of said inverter stages and an output terminal of said photo-electric sensing means, said variable resistor functioning as adjustment means for adjusting the level of voltage supplied to said ring oscillator circuit from said photo-electric sensing means.

12. An electronic timepiece as claimed in claim 1, in which said photo-electric sensing means comprise an amorphous silicon solar cell.

13. An electronic timepiece as claimed in claim 1, in which said frequency measurement circuit means are responsive to said timing signals from said timekeeping circuit means for periodically generating a gate timing signal pulse, and in which said frequency measurement circuit means further comprise counter circuit means and gate circuit means, said gate circuit means being responsive to said gate timing signal pulse for transferring said oscillation signal from said illumination-controlled oscillator circuit means to be counted by said counter circuit means, with the count value in said counter circuit means at the completion of said gate timing signal pulse representing said digital data indicative of the frequency of said oscillation signal.

* * * * *